United States Patent [19]

Young

[11] 4,325,511

[45] Apr. 20, 1982

[54] METHOD FOR FORMING RAIL CLIPS

[75] Inventor: Hartley F. Young, Melton, Australia

[73] Assignee: Ralph McKay Limited, Victoria, Australia

[21] Appl. No.: 36,148

[22] Filed: May 4, 1979

[30] Foreign Application Priority Data

May 8, 1978 [AU] Australia ..... PD4318

[51] Int. Cl.[3] ..... E01B 9/28; B21D 53/36

[52] U.S. Cl. ..... 238/349; 29/DIG. 49

[58] Field of Search ..... 238/349; 29/DIG. 49

[56] References Cited

U.S. PATENT DOCUMENTS

| | | | |
|---|---|---|---|
| 2,112,231 | 3/1938 | Speidel | 29/DIG. 49 |
| 2,517,497 | 8/1950 | Lavenstein | 29/DIG. 49 |
| 3,067,947 | 12/1962 | Deenik | 238/349 |
| 3,515,347 | 6/1970 | Waters et al. | 238/349 |
| 3,970,248 | 7/1976 | Molyneux | 238/349 |

*Primary Examiner*—Richard A. Bertsch

*Attorney, Agent, or Firm*—Christel, Bean & Linihan

[57] ABSTRACT

Improvement in rail clips formed from metal plate in which the edges of the clip arms adjacent the locations of the clip subject to highest stress, are coined to prevent stress fractures occurring. The preferred form of rail clip is a D configuration in side view in which one portion seats on the foot of the rail and the other portion seats in a clip holder secured to a rail sleeper.

5 Claims, 2 Drawing Figures

METHOD FOR FORMING RAIL CLIPS

This invention relates to rail clips for fastening rails to sleepers.

A number of rail clips have been proposed which are manufactured by blanking and shaping steel plate. Such clips take various shapes. One such clip comprises a curved plate having a central hole through which a bolt projects into the sleeper, the plate having one edge adapted to lie over the foot of the rail. This rail clip has points of high stress adjacent the blanked bolt hole and the outer edges of the clip adjacent the bolt hole. Another clip made from blanked plate material is of U shaped cross section wherein the free ends of the U are bent about at least two points to be adjacent the base of said U. In this clip design the high stress points lie on the inner edges of the arms of the U adjacent the base of the U. This latter clip is preferred for the present invention and is the subject of Australian Patent application No. 37379/78.

Where clips of this kind have been blanked from plate material the edges are often rough. It has been discovered that in areas of high stress fractures of the clips can be started from small cracks or irregularities in the edges of the clips. Thus to reduce the occurrence of fatigue and fractures in rail clips formed by blanking the clips from metal plate the present invention provides the step of coining the edges of the blanked out clip corresponding to those edges of the finished clip, which are subject to high stress.

The coining operation provides a smooth edge surface adjacent the high stress points and eliminates the possibility of a fracture commencing from a rough edge portion.

The drawings illustrate one particular form of rail clip to which the present invention relates.

Figure 1:
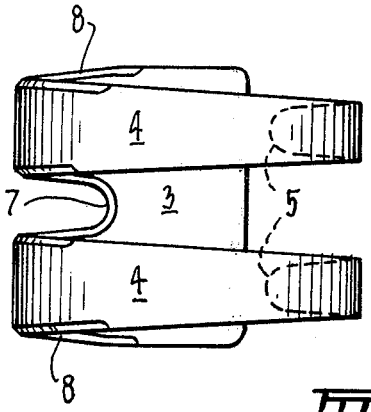
Figure 2:
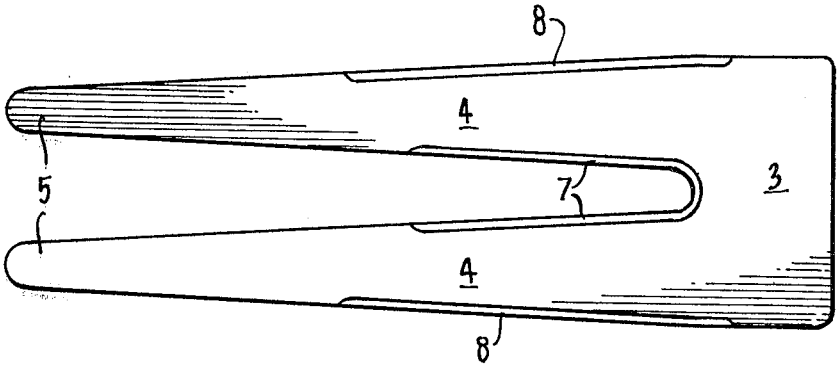

FIG. 1 is a plan view of a rail clip formed from the blank of FIG. 2 into a curved clip the free ends of which lie adjacent to the base section and slightly below the plane of the base section.

The clip comprises a base section 3 arms 4 extending from said base section and terminating in free ends 5. When the rail clip as shown in FIG. 1 is in position and the free ends of the clip are abutting the foot of the rail, any deflection will cause the free ends 5 to move relative to the base section 3. Major stress will occur in the internal portions 7 of the arms 4 adjacent the base 3 particularly where the arms are curved. To reduce the likelihood of stress causing fractures the edges 7 of the arms 4 and base section 3 are coined. Generally it is only necessary to coin the internal edges 7 as shown in the drawings. However it is of some value to further coin the corresponding outer edges 8 as shown.

The coining operation is preferably carried out between the blanking and forming operations. The edges to be treated are ground with an appropriate tool to coin the edges and eliminate surface deformations.

I claim:

1. A method of forming integral rail clips of the kind in which one portion of the clip is secured by clip holding means to a rail tie and a second portion overlies the foot of a rail comprising a blanking a generally U-shaped clip having tapered arms from metal plate , forming the blank into a three dimensional shape wherein the arms of the U curve over the base and terminate beyond the base, and coining the edges of said clip adjacent the base of the U where said clip is subjected to maximum stress during use, said base corresponding to the portion of the clip which is secured by the clip holding means and the ends of the arms correspond to the portion which overlies the foot of the rail.

2. A method as claimed in claim 1 in which the inner edges of the clip adjacent the portion of the clip which is secured by the clip holding means are coined.

3. A rail clip formed from metal plate by blanking comprising a base section, two tapered arms extending in parallel from said base in an arc over said base, said arms terminating adjacent said base, and wherein the inner edges of said two arms are coined in the region adjacent the junction of the arms and the base where said clip is subjected to maximum stress during use.

4. A method as claimed in claims 1 or 2 in which the outer edges of the clip adjacent the portion of the clip which is secured by the clip holding means are coined.

5. A method as claimed in claim 3 wherein the outer edges of said two arms are coined in the region adjacent the junction of the arms and the base.

* * * * *